US005899417A

United States Patent [19]

Gsodam et al.

[11] Patent Number: 5,899,417

[45] Date of Patent: May 4, 1999

[54] DEVICE FOR SECURING STOCK RAILS IN RAILWAY SWITCHES

[75] Inventors: Hannes Gsodam, Reichenfels; Heinz Ossberger, Grosslobming, both of Austria

[73] Assignee: VAE Aktiengesellschaft, Vienna, Austria

[21] Appl. No.: 08/973,214

[22] PCT Filed: Jun. 5, 1996

[86] PCT No.: PCT/AT96/00102

§ 371 Date: Dec. 4, 1997

§ 102(e) Date: Dec. 4, 1997

[87] PCT Pub. No.: WO96/41920

PCT Pub. Date: Dec. 27, 1996

[30] Foreign Application Priority Data

Jun. 9, 1995 [AT] Austria ..... 984/95

[51] Int. Cl.[6] ..... E01B 7/22

[52] U.S. Cl. ..... 246/453

[58] Field of Search ..... 246/453, 415 R; 238/349, 354

[56] References Cited

FOREIGN PATENT DOCUMENTS 3213345 3/1975 Austria .

343149 11/1989 European Pat. Off. .

2698642 6/1994 France ..... 238/349

294613 10/1991 Germany ..... 246/453

42 29 014 3/1994 WIPO .

*Primary Examiner*—S. Joseph Morano

*Attorney, Agent, or Firm*—Pillsbury Madison & Sutro LLP

[57] ABSTRACT

In a device for securing stock rails in railway switches comprising a bearing plate (2) for the stock rail (1), a slide chair (3) for the switch blade and an elongate spring element (6) for holding down the rail foot (1), the spring element (6) is insertable into a tunnel-shaped recess (5) of the slide chair (3) at a tension insufficient for holding down the rail foot (1), or without any tension at all, and is braceable relative to the rail foot (1) and the bearing plate (2) by a separate clamping wedge (10) extending transverse to the spring element (6). The spring element (6) has a cross section varying over its length and, starting from a central region in which it cooperates with the transverse wedge (10), tapers towards its two free ends and, on its free end (9) facing away from the rail foot (1), is designed to project towards the bearing plate (2).

4 Claims, 2 Drawing Sheets

DEVICE FOR SECURING STOCK RAILS IN RAILWAY SWITCHES

This application is the national phase of international application PCT/AT96/00102, filed Jun. 5, 1996 which designated the U.S.

BACKGROUND OF THE INVENTION

1. Field of the Invention

The invention relates to a device for securing stock rails in railway switches comprising a bearing plate for the stock rail, a slide chair for the switch blade and an elongate spring element for holding down the rail foot, which spring element is insertable into a tunnel-shaped recess of the slide chair at a tension insufficient for holding down the rail foot, or without any tension at all, and is braceable relative to the rail foot and the bearing plate by a separate clamping wedge extending transverse to the spring element.

2. Prior Art

A device of the initially defined kind may be taken from Austrian Patent No. 321 345. An essential advantage of the known configuration resides in that driving in of the spring element may be effected without any tension, without having to overcome frictional forces during driving in. A defined spring tension that serves to brace the spring element against the rail foot is applied by the transverse wedge introduced subsequently. Since bracing of the spring element against the foot of the stock rail is not effected during the insertion of the spring element, the spring element can be readily inserted into the recess of the slide chair, wherein the spring element in that known embodiment is supported against the wedge in its central zone while the end facing away from the rail foot bears against the bearing plate.

In the known configuration a substantially plate-shaped spring element was used. Due to the spring element being deflected upon driving in of the transverse wedge, the spring element in such a configuration bears against the bearing plate over a more or less large portion on its side facing away from the rail foot of the stock rail, the bearing site being not precisely defined though. The exactly reproducible application of a defined spring force on the foot of the stock rail is affected by the undefined configuration of the abutment on the bearing plate. It must be initially assumed, in particular, that the transverse wedge driven in to define the spring force is to have but a relatively slight inclination in order to remain self-lockingly and safely in its position. Furthermore, the end position of the inserted transverse wedge is to correspond to the respectively desired application force. A shift of the bearing point of the end of the spring element facing away from the rail foot naturally also entails a variable force absorption of the spring element and a substantially uniform cross-sectional height of the plate-shaped spring element involves a relatively irregular force absorption of the stresses occurring in the spring.

SUMMARY OF THE INVENTION

The invention aims at enhancing the force absorption of the spring element while substantially reducing the risk of fracture of such springs. In addition, the configuration according to the invention aims at guaranteeing a more readily reproducible, defined application force acting on the rail foot. Departing from the intially defined device, the configuration according to the invention to solve this object essentially consists in that the spring element has a cross section varying over its length and, starting from a central region in which it cooperates with the transverse wedge, tapers towards its two free ends and, on its free end facing away from the rail foot, is designed to project towards the bearing plate. Due to the fact that the spring element has a cross section varying over its length and tapers towards its two free ends starting, in particular, from a central region in which it cooperates with the transverse wedge, a reduced tension in the spring is ensured at simultaneously elevated clamping forces by the cross section of the plate spring being increased in the region of the clamping wedge. The end of the plate spring element being designed to project towards the bearing plate on its free end facing away from the rail foot causes the rear bearing point on the bearing plate to be precisely defined such that a precisely defined application force will be obtained on the rail foot after driving in of the transverse wedge. The special shape of the spring element, thus, yields a precise and reproducible application force of the spring in the region of the rail foot at low stresses in the spring and simultaneously elevated clamping forces.

According to a preferred further development of the device according to the invention, the configuration is such that the end of the spring element facing the rail foot has a smaller cross sectional height than the smallest cross sectional height near the bearing point of the spring element on the bearing plate. Such a configuration provides for the high stability sought in the region of the rail foot, taking into account that the transverse wedge is driven in in a region of the spring element that does not exactly correspond with the longitudinal center of the spring element. In a particularly advantageous manner, the configuration is devised such that the cross sectional height of the part of the spring element resting on the bearing plate approximately corresponds to the cross sectional height of the central region of the spring element, thereby providing the required clearance and ensuring that the rear bearing point is actually located in the region of the projection of the spring element in the direction towards the bearing plate. With a simultaneously thickened section provided in the central region, a defined bearing point provided on the rear end and the double-conical design of the cross section, a particularly favorable force introduction has become feasible at the lowest stresses in the spring and, at the same time, particularly high clamping forces by arranging the largest cross sectional height of the spring element at a distance from the end facing the rail foot, that corresponds to ⅓ to ¼ of the overall length of the spring element.

BRIEF DESCRIPTION OF THE DRAWINGS

In the following, the invention will be explained in more detail by way of an exemplary embodiment schematically illustrated in the drawing.

Therein.

DETAILED DESCRIPTION OF A PREFERRED EMBODIMENT OF THE INVENTION

Figure 1:
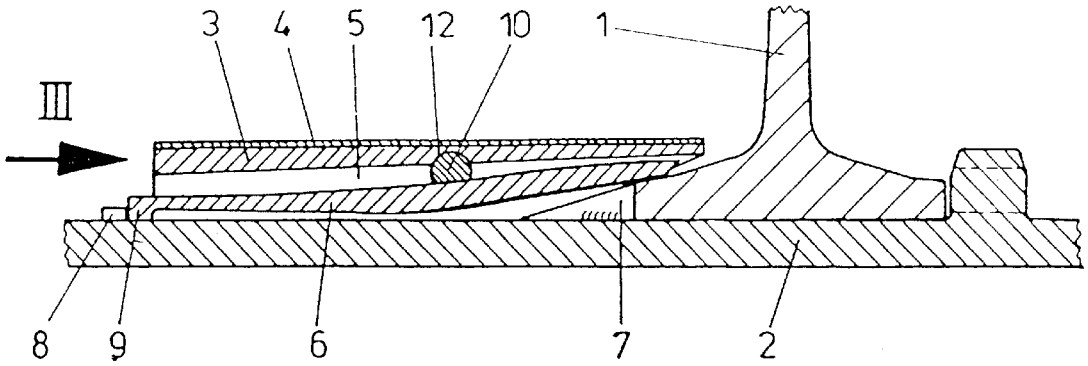
FIG. 1 is a section through a slide chair along line I/I of FIG. 2.
Figure 2:
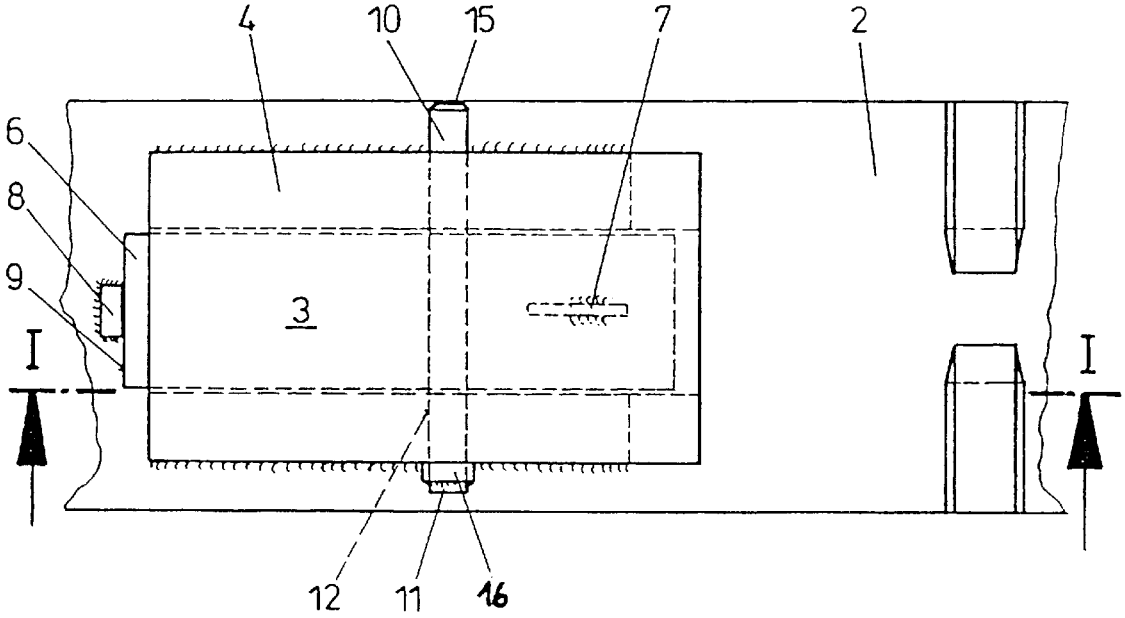
FIG. 2 is a top view with the stock rail removed.
Figure 3:
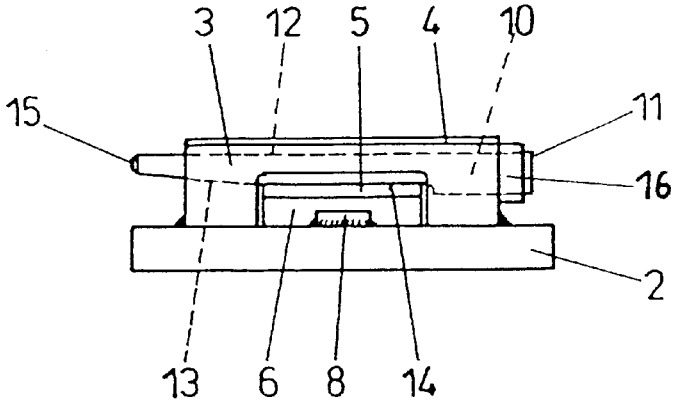
FIG. 3 is a view in the direction of arrow III.

In the illustrations according to FIGS. 1 to 4 of the drawing, 1 serves to denote the stock rail and foot, 2 the bearing plate, 3 the slide chair and 4 the layer of slidable material applied on the surface of the slide chair.

The slide chair 3 has a tunnel-shaped recess 5 into which an elongate plate-shaped spring element 6 is inserted in the direction towards the stock rail 1. The spring element 6 is directed onto the rail foot 1 by a wedge-shaped support 7 welded to the bearing plate. To the bearing plate 2 is welded a stop 8 which cooperates with the end 9 of the spring element 6 facing away from the stock rail 1, securing said spring element in the operating position even if vibrations occur.

As soon as the spring element 6 has been positioned, a transverse wedge or cotter 10 is driven into a transverse bore 12 of the slide chair by striking on its thicker end 11. In this manner, the central region of the spring element 6 is braced downwards thus keeping the foot 1 of the stock rail down.

The cotter 10 comprises a flattened portion 13 extending in the manner of a wedge and cooperating with the spring element during driving in. In the region 14, said flattend portion has no taper such that the cotter 10 is secured in its position. Optionally, also the projecting tapered end 15 may be secured by means of a split-pin or the like. By striking on the tapered end 15, the wedge may be loosened again. The drive-in path of the wedge 10 is limited by a thickened head 16.

Figure 4:
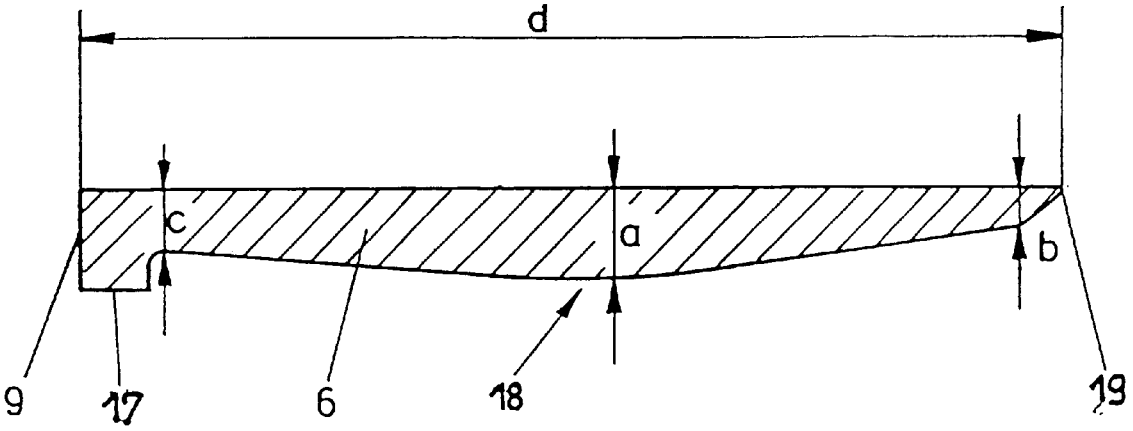
FIG. 4 is an enlarged illustration of the cross section of a spring element according to the invention.

FIG. 4 depicts the spring element 6 on an enlarged scale. The end 9 facing away from the stock rail comprises a downwardly extending projection 17. Starting from a central region 18, which is located substantially below the cotter 10 visible from FIGS. 1 to 3 and has the relatively largest cross sectional height a, the cross section is conically tapering towards both end 9 and the end 19 overlapping the rail foot, appropriate clearance being ensured in the rear region in the direction towards the projection 17 even upon bending of the spring element 6. The region of the largest cross sectional height a is located at a distance from the end 19 of the spring element 6 facing the rail foot, that corresponds approximately to one third of the overall length d of the spring element 6. The cross sectional height b is smaller than the smallest cross sectional height c near the projection 17 on the end 9 of the spring element 6 facing away from the rail foot, thereby safeguarding that the spring element 6 is sufficiently flexible in the region of the rail foot despite high tensional forces so as to ensure application over the total width of the spring element 6 and hence at a favorable force introduction into the rail foot.

We claim:

1. A device for securing a stock rail in a railway switch, comprising:

a bearing plate for receiving a foot portion of the stock rail;

a slide chair portion of a blade of said switch, said slide chair being provided with a tunnel-shaped recess;

a spring element positioned within said recess, said spring element including a first free end resting on the foot portion of the stock rail and a second free end having a projection which rests on the bearing plate at a location spaced from said foot portion, said spring element including a central region located intermediate the free ends and having a cross-section which is tapered in the direction of the free ends, the cross-section of the central region having a height greater than a cross-sectional height of the second free end of the spring adjacent said projection and having a still greater height than a cross-sectional height of the first free end of the spring element resting on the foot position; and a clamping wedge inserted within said recess between the slide chair portion of the switch blade and said spring element for securing the stock rail on the bearing plate.

2. A device according to claim 1, wherein the cross-sectional height of the the second free end of the spring element and the projection which rests on the bearing plate substantially corresponds to the cross-sectional height of the central region of the spring element.

3. A device according to claim 2, wherein the largest cross-sectional height of the spring element is arranged at a distance from the first free end which corresponds to ⅓ to ¼ of the overall length of the spring element.

4. A device according to claim 1, wherein the largest cross-sectional height of the spring element is arranged at a distance from the first free end which corresponds to ⅓ to ¼ of the overall length of the spring element.

* * * * *